United States Patent [19]

Schuchman, Sr.

[11] 4,083,446

[45] Apr. 11, 1978

[54] COMBINATION CARD HOLDER AND DECORATIVE ELEMENT

[76] Inventor: Frederick E. Schuchman, Sr., Gateway Towers, Pittsburgh, Pa. 15222

[21] Appl. No.: 790,447

[22] Filed: Apr. 25, 1977

[51] Int. Cl.[2] ..... A45C 15/00; A41B 15/00

[52] U.S. Cl. ..... 206/38; 2/279; 206/457

[58] Field of Search ..... 206/38, 278, 457; 2/279; 24/11

[56] References Cited

U.S. PATENT DOCUMENTS

| | | | |
|---|---|---|---|
| 2,022,793 | 12/1935 | Trickel | 2/279 |
| 2,079,139 | 5/1937 | Woof | 2/279 |
| 2,176,791 | 10/1939 | Cronn | 206/38 |
| 2,597,146 | 5/1952 | Ginal, Jr. | 2/279 |
| 2,968,045 | 1/1961 | Johnson | 2/279 |
| 3,128,514 | 4/1964 | Parker et al. | 24/11 |

*Primary Examiner*—William T. Dixson, Jr.
*Attorney, Agent, or Firm*—Brown, Murray, Flick & Peckham

[57] ABSTRACT

An open-top card-receiving sheath adapted to be inserted in the breast pocket of a man's jacket is detachably connected to a substantially rectangular fabric member in front of it that is at least as wide as the sheath. The appearance of the front of the upper portion of the fabric member is different from the appearance of the front of its lower portion, and the upper portion extends above the sheath for exposure above the pocket. Since either end of the fabric member can be placed uppermost, this decorative element can match the appearance of either of two different cravats.

3 Claims, 4 Drawing Figures

COMBINATION CARD HOLDER AND DECORATIVE ELEMENT

Many men often carry handkerchiefs in the breast pockets of their suit coats or jackets. Such a handkerchief generally is not intended for use but solely for a decorative purpose, so it is folded neatly and placed so that some of it will extend above the pocket and be visible to others. Frequently, the handkerchief matches in appearance the necktie or cravat worn by the man, and it often is made of the same material. Also, it is common practice for men to carry visiting cards and credit cards. These are usually carried in a wallet that also contains money. It is seldom satisfactory to carry the cards in the breast pocket of a jacket when there is a handkerchief in that pocket, because there would be too much bulk and the pocket would bulge out too much.

It is an object of this invention to provide a combination card holder and decorative element for the breast pocket of a man's jacket. Another object is to provide such a decorative element that will have the appearance of a handkerchief projecting from the pocket and yet, with the card holder, will not distort the pocket objectionably.

The preferred embodiment of the invention is illustrated in the accompanying drawings, in which FIG. 1 is a fragmentary front view of a man wearing a jacket with a breast pocket containing the card holder and decorative member;

Figure 1:
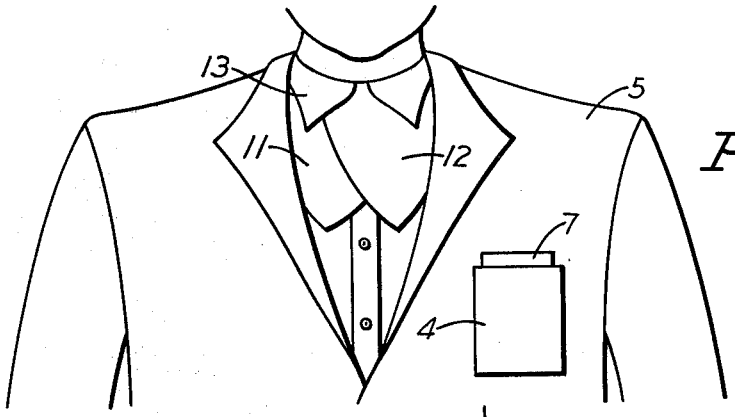
Figure 3:
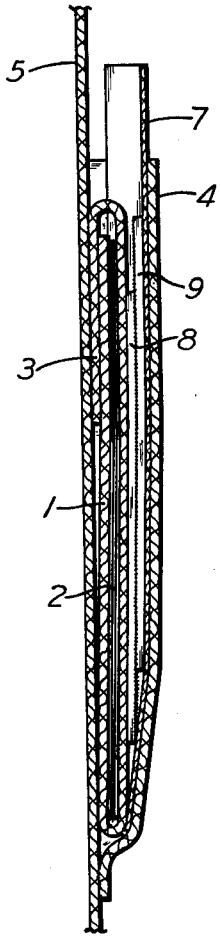
FIG. 3 is a vertical section taken on the line III—III of FIG. 2.
Figure 2:
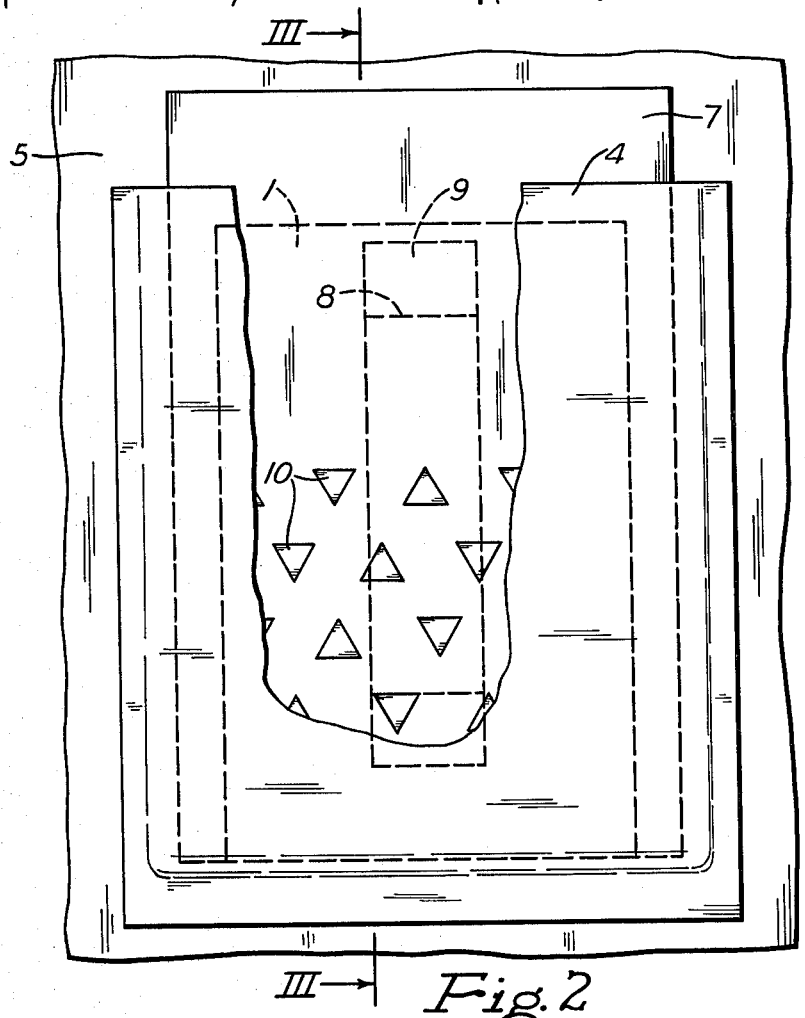
FIG. 2 is an enlarged front view of the pocket, partly broken away.
Figure 4:
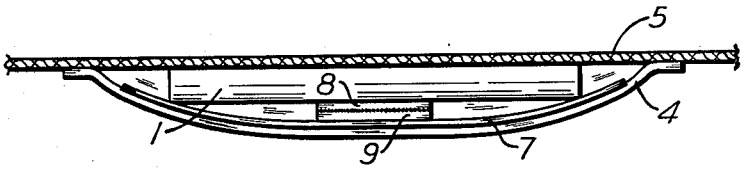
FIG. 4 is a plan view of the pocket and its contents.

Referring to the drawings, a card-receiving case or sheath 1 of a size to accommodate visiting cards 2 and the like has an open upper end that can be closed by a flap 3 formed from an extension of the front side of the sheath. Although the sheath may be made of a plastic, it is preferred to make it of cloth, which is likely to be more flexible and less bulky than a plastic. The height of the sheath is somewhat less than the depth of the average breast pocket 4 of a man's jacket 5, so that when the sheath is placed in the pocket it will not be visible.

It is a feature of this invention that detachably connected to the front of the card case there is a decorative element that will extend above the breast pocket like a handkerchief would and which it appears to others to be. Accordingly, a relatively short length of fabric 7, which preferably is rectangular and is at least as wide as the card sheath and most suitably nearly as wide as the pocket, completely covers the front of the case. The fabric member, which serves as the decorative element, is detachably connected to the card case by, for example, a Velcor fastener. As is well known, a Velcor fastener is formed from two strips 8 and 9 disposed face to face. One of the strips is formed from a myriad of tiny plastic hooks, and the other strip is a plastic fiber mat with which the hooks engage when pressed together. One of these strips is permanently attached to the front of the card case, and the other fastener strip 9 is likewise permanently attached to the back of the fabric member. The strips extend vertically.

The reason for fastening the decorative element to the card sheath by means of a detachable connection is to permit either end of the fabric member to be placed uppermost. The decorative element is attached to the sheath in such a position that it will extend the desired distance above case and a breast pocket when the assembly is placed in the pocket. Since with a Velcor fastener the decorative element can be attached to the card case at any desired height, the length of the decorative element vertically is not critical. However, it is preferred to make the decorative element long enough so that when its lower end is nearly even with the bottom of the case, its upper end portion will extend the desired distance above the case.

The reason that it is desirable to place either end of the decorative element uppermost is that its opposite ends are different in appearance from each other. For example, one end portion may be red and the other end portion green, or one may be a plain color or white and the other provided with stripes or designs 10. Consequently, when one end of the decorative element projects above a breast pocket, the element will have one appearance, but if it is turned end for end the projecting part then will have another appearance. Preferably, the dividing line between the two colors is midway between the upper and lower ends of the fabric member. The latter most suitably is made double thickness to impart some stiffness to it so that the part that projects from a pocket will stand up straight.

A decorative element of the type just described not only permits either of two different colors or designs to be displayed above a breast pocket, but the detachable fastening permits other decorative elements of the same type but of still other colors and designs to be fastened to the card case in place of the one described, thereby allowing considerable variety. Furthermore, an important advantage is that it is possible with one decorative element of the kind disclosed to match two different cravats, so that when a different cravat is worn, the decorative element that matched the first cravat can be removed from the card case, turned end for end and reattached to the case in order to match the second cravat. If desired, the cravat itself can be made reversible to expose a different color or figure, with one side matching one end of the decorative element and the opposite side matching the other side of that element. As shown in FIG. 1, such a cravat preferably is made by stitching the upper ends of pieces 11 and 12 of suitable fabric, such as silk, to an elastic neck band, the ends of which are provided with a hook and eye for fastening them together beneath a shirt collar 13. By using a relatively narrow neck band, it will be more comfortable than a wide band to wear in hot weather.

With the invention disclosed herein, a man's cards can be carried conveniently in the breast pocket of his jacket where they will be readily accessible. Although the decorative element will be removed from the pocket whenever the card case is, the flat decorative element will slide back into the pocket with the attached case without any fuss, unlike a handkerchief that has to be folded and adjusted when inserted in a breast pocket for decorative purposes.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A combination card holder and decorative element comprising an open-top card-receiving sheath adapted to be inserted in the breast pocket of a man's jacket, said sheath having a front and a back, a substantially rectangular fabric member in front of the sheath and having a front and a back and upper and lower end portions, said fabric member being at least as wide as said sheath, the appearance of the front of the upper portion of the fabric member being different from the appearance of the front of its lower portion, and separable fastening means attached to the front of the sheath and the back of the fabric member for detachably connecting them together with either end portion of said member extending above the sheath for exposure above a pocket, whereby said decorative element can match the appearance of either of two different cravats.

2. A combination card holder and decorative device according to claim 1, in which said separable fastening means consist of two cooperating strips extending vertically, one of said strips carrying a large number of plastic hooks and the other strip carrying plastic pile material engageable by said hooks to connect the two strips together, whereby said fabric member can be adjusted vertically relative to said sheath.

3. A combination card holder and decorative device according to claim 2, in which said decorative element is longer than said sheath so that their lower ends can be disposed at substantially the same level in a pocket.

* * * * *